US006874997B2

(12) United States Patent
Watanabe et al.

(10) Patent No.: US 6,874,997 B2
(45) Date of Patent: Apr. 5, 2005

(54) PUMP SYSTEM USING A CONTROL FLUID TO DRIVE A SWITCHING VALVE MECHANISM FOR AN ACTUATING FLUID

(75) Inventors: Tsuyoshi Watanabe, Iruma-gun (JP); Masao Morishita, Iruma-gun (JP); Tsutomu Sawada, Iruma-gun (JP); Toshiki Oniduka, Iruma-gun (JP)

(73) Assignee: Iwaki Co., Ltd., Tokyo (JP)

( * ) Notice: Subject to any disclaimer, the term of this patent is extended or adjusted under 35 U.S.C. 154(b) by 67 days.

(21) Appl. No.: 10/290,169

(22) Filed: Nov. 8, 2002

(65) Prior Publication Data

US 2003/0198561 A1 Oct. 23, 2003

(30) Foreign Application Priority Data

Apr. 19, 2002 (JP) ..... 2002-118247

(51) Int. Cl.[7] ..... F04B 45/033

(52) U.S. Cl. ..... 417/395; 417/393; 417/399; 417/441; 417/401; 417/473; 91/297; 91/298

(58) Field of Search ..... 417/395, 393, 417/401, 399, 441, 472, 473; 91/290, 291, 292, 296, 297, 298

(56) References Cited

U.S. PATENT DOCUMENTS

| | | | | |
|---|---|---|---|---|
| 3,838,946 | A | * 10/1974 | Schall | 417/395 |
| 5,062,770 | A | * 11/1991 | Story et al. | 417/46 |
| 5,480,292 | A | * 1/1996 | Chevallier | 417/393 |
| 5,558,506 | A | * 9/1996 | Simmons et al. | 417/393 |
| 5,893,707 | A | * 4/1999 | Simmons et al. | 417/393 |
| 5,927,954 | A | * 7/1999 | Kennedy et al. | 417/397 |
| 6,619,932 | B2 | * 9/2003 | Murata | 417/395 |
| 6,644,941 | B1 | * 11/2003 | Able et al. | 417/393 |
| 6,685,443 | B2 | * 2/2004 | Simmons et al. | 417/395 |

* cited by examiner

*Primary Examiner*—Cheryl Tyler
*Assistant Examiner*—Emmanuel Sayoc
(74) *Attorney, Agent, or Firm*—Oliff & Berridge, PLC

(57) ABSTRACT

There is provided a pump system excellent in a maintenance ability and compatibility. The pump system comprises a pump (1) for transferring a liquid by alternately supplying air to air chambers (17*a*, 17*b*) to extend and contract a pair of bellows (13*a*, 13*b*) linked to a shaft (15). It also comprises a switching valve mechanism (2) for switching the air supplied to the pump (1). Switching mechanisms (40*a*, 40*b*) are employed to switch the pilot air for controlling the switching operation of the switching valve mechanism (2). The switching mechanisms are detachably attached to cases (16*a*, 16*b*) of the pump (1) from outside.

10 Claims, 7 Drawing Sheets

PUMP SYSTEM USING A CONTROL FLUID TO DRIVE A SWITCHING VALVE MECHANISM FOR AN ACTUATING FLUID

CROSS REFERENCE TO RELATED APPLICATION

This application is based on and claims the benefit of prior Japanese Patent Application No. 2002-118247, filed on Apr. 19, 2002, the entire contents of which are incorporated herein by reference.

BACKGROUND OF THE INVENTION

1. Field of the Invention

The present invention relates to a pump system for transferring a target fluid via a pump camber using reciprocating flexible members such bellows and diaphragms. In particular, it relates to a pump system using a control fluid to drive a switching valve mechanism for an actuating fluid.

2. Description of the Related Art

A bellows pump is known as a liquid injection pump for use in semiconductor processes and so forth in the art. It employs fluororesin bellows for sucking and discharging a liquid. The bellows pump includes a pump head containing a valve unit; a pair of bellows located at both sides of the pump head to form pump chambers inside these bellows; and a case for covering the outside of the bellows to form a pair of air chambers. When an air is supplied alternately into the air chambers to extend and contract the bellows, a target fluid such as a liquid can be transferred as it is sucked into and discharged from the pump chamber.

The air is supplied from an air source, switched at a switching valve mechanism such as a magnetic valve and fed as an actuating fluid alternately to the pair of air chambers. As for switching control of the switching valve mechanism, proximity switches are located at both ends of the case to detect a moving end of each bellows. The use of the proximity switches requires metals and wires arranged in the sensor sections. Generally, inside the pump chamber is a first liquid-contact section and the air chamber is a second liquid-contact section that is a liquid-free section. The proximity switch may be often located in the second liquid-contact section. In the case of a pump for transferring a metal-corrosive target fluid, however, it is desired to avoid the use of metals and metallic wires in the second liquid-contact section as far as possible.

In known bellows pumps of an all air type, a switching valve mechanism is switched under pressure of a fluid (control fluid) branched from the actuating fluid (U.S. Pat. No. 5,893,707 and U.S. Pat. No. 5,558,506).

The above-described bellows pumps of the all air type include one that houses a switching mechanism for switching the switching valve mechanism in a pump case as disclosed in U.S. Pat. No. 5,893,707. This rises a problem because of the poor maintenance ability for the switching mechanism and no compatibility with a switching mechanism of the proximity switch type. In the bellows pump disclosed in U.S. Pat. No. 5,558,506, as a part of a switching mechanism for switching the switching valve mechanism, a piston is fixed to a reciprocating shaft. Accordingly, the switching mechanism can not be detached and attached individually. This also rises a problem because of the poor maintenance ability for the switching mechanism and no compatibility with a switching mechanism of the proximity switch type.

The use of the proximity switch has merits because: (1) the number of reciprocating strokes of the pump can be converted into a discharged flow amount; and (2) the pump halting due to some trouble can be detected from an electric signal. Therefore, it is greatly significant to replace the switching mechanism of the all air type for the proximity switch type.

SUMMARY OF THE INVENTION

The present invention has been made in consideration of the above situation and accordingly has an object to provide a pump system excellent in the maintenance ability and compatibility.

According to the present invention, a pump system comprises a pump and a switching valve mechanism. The pump includes a pump head having an inlet and an outlet for a target fluid to be transferred and including a valve unit for routing the target fluid from the inlet to the outlet, a shaft passing through the pump head for reciprocating therethrough, a first and a second flexible members linked to both ends of the shaft to form a first and a second pump chambers at both sides of the pump shaft for introducing the target fluid through the valve unit, a first and a second cases for housing the first and second flexible members individually to form a first and a second actuating fluid chambers for introducing an actuating fluid into spaces outside the first and second flexible members, and a first and second switching mechanisms detachably attached to the cases from outside and located in the axial direction at both sides of the shaft, having flow paths formed therein for branching part of the actuating fluid and including movable members reciprocating together with the shaft in a state not fixed to the shaft, in which the movable member opens the flow path to branch part of the actuating fluid as a control fluid when the shaft reaches one of limits of reciprocation. The switching valve mechanism alternately distributes an actuating fluid supplied from an actuating fluid source to the pair of actuating fluid chambers using the control fluid branched at the switching mechanisms. The actuating fluid is alternately introduced into the pair of actuating fluid chambers to drive the shaft back and forth in opposite phases to suck and discharge the target fluid.

According to the present invention, in the pump system of the type that employs the control fluid branched from the actuating fluid to switch the switching valve mechanism, the switching mechanism for branching the actuating fluid is detachably attached to the case from outside. In addition, the movable member reciprocating together with the shaft is not fixed to the shaft. Therefore, it is easy to remove the switching mechanism entirely from the case. This is effective to improve the maintenance ability. It is also possible to remove the switching mechanism entirely to replace for a switching mechanism of a proximity switch type. This is effective to improve the compatibility.

In an embodiment of the present invention, the switching valve mechanism includes a switching valve mechanism body having a distribution chamber formed therein for distributing the actuating fluid, and a switching valve capable of reciprocating and located inside the distribution chamber in the switching valve mechanism body. The switching valve mechanism body has an introduction orifice formed for introducing the actuating fluid from the actuating fluid source into the distribution chamber, a first and a second actuating fluid orifices formed for discharging the actuating fluid introduced into the distribution chamber to the pump and introducing the actuating fluid discharged from the pump into the distribution chamber, a first and a second discharge orifices formed for discharging the actuating fluid discharged from the pump, and a first and a second control fluid orifices formed for introducing and discharging a control fluid branched from the actuating fluid. The switching valve is operative to switch between a first state and a second state when the control fluid drives the switching valve back and forth. In the first state the introduction orifice is communicated with the first actuating fluid orifice and the second actuating fluid orifice with the second discharge orifice. In the second state the introduction orifice is communicated with the second actuating fluid orifice and the first actuating fluid orifice with the first discharge orifice.

In an embodiment of the present invention, the pump system further comprises a first main conduit for connecting the first actuating fluid orifice in the switching valve mechanism with the first actuating chamber; a second main conduit for connecting the second actuating fluid orifice in the switching valve mechanism with the second actuating chamber; a first control fluid introduction path for introducing part of the actuating fluid as a control fluid into a flow path in the first switching mechanism; a second control fluid introduction path for introducing part of the actuating fluid as a control fluid into a flow path in the second switching mechanism; a first control fluid conduit for introducing the control fluid discharged from the flow path in the first switching mechanism into the first control fluid orifice in the switching valve mechanism; and a second control fluid conduit for introducing the control fluid discharged from the flow path in the second switching mechanism into the second control fluid orifice in the switching valve mechanism.

In an embodiment of the present invention, the switching mechanism includes a cylinder detachably fixed to the case from outside and having a discharge orifice for the control fluid formed at a side, and a rod serving as the movable member for reciprocating along with the shaft within the cylinder, having an introduction orifice for the actuating fluid or the control fluid formed at an end, and a discharge orifice for the control fluid formed in communication with the introduction orifice at a side. The discharge orifice in the rod communicates with the discharge orifice in the cylinder when the rod reaches one of limits of reciprocation thereof.

In another embodiment of the present invention, the switching mechanism includes a movable member case detachably fixed to the case from outside and having a discharge orifice for the control fluid formed at a side, a rod serving as the movable member for reciprocating within the movable member case, the rod having a tip protruded from the movable member case and contacted with the flexible member, an introduction orifice for the control fluid formed in the tip contacted with the flexible member, and a discharge orifice for the control fluid formed in communication with the introduction orifice at a certain location, and a resilient member for driving the rod toward the flexible member. The tip of the rod separates from the flexible member and the discharge orifice in the rod communicates with the discharge orifice in the cylinder when the shaft reaches in the vicinity of one of limits of reciprocation thereof.

In yet another embodiment of the present invention, the switching mechanism includes a ball valve case detachably fixed to the case from outside and having an introduction orifice for the control fluid formed at an end and a discharge orifice for the control fluid formed at a side, a rod serving as the movable member for reciprocating within the ball valve case and having a tip protruded from the ball valve case, in which the rod contacts with the flexible member and moves back when the flexible member reaches in the vicinity of a limit of reciprocation, and a ball valve housed in the ball valve case, in which the ball valve is opened to communicate the introduction orifice with the discharge orifice for the control fluid when the rod moves back and the rear end of the rod pushes the rod.

The flexible member may comprise a bellows or diaphragm. Preferably, the switching mechanism is composed of a ceramic or resin.

BRIEF DESCRIPTION OF THE DRAWINGS

The present invention will be more fully understood from the following detailed description with reference to the accompanying drawings, in which.

DETAILED DESCRIPTION OF THE PREFERRED EMBODIMENTS

Preferred embodiments of the present invention will be described below based on the drawings.

First Embodiment

Figure 1:
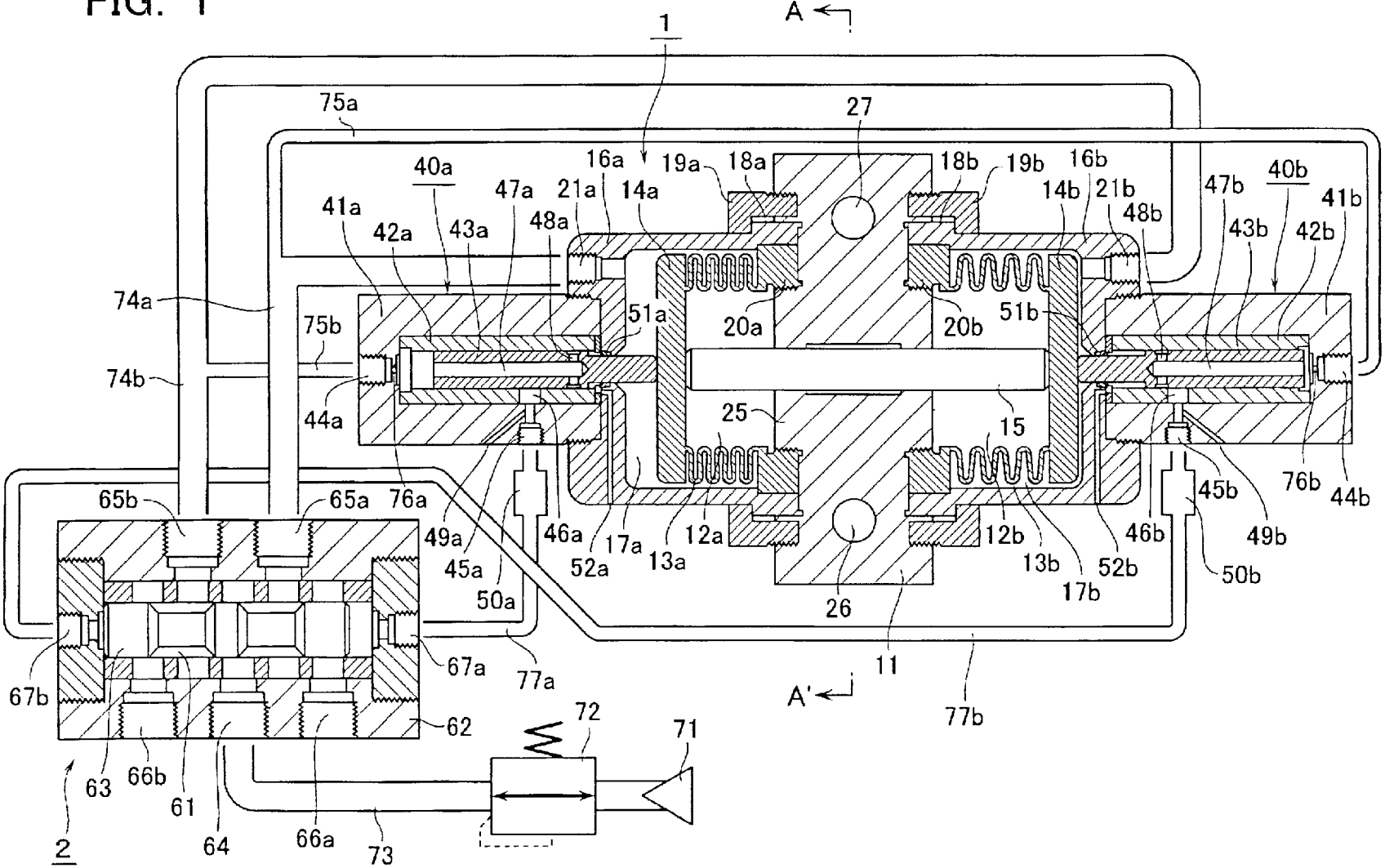
FIG. 1 is a cross-sectional view showing an arrangement of a pump system according to a first embodiment of the present invention.
Figure 2:
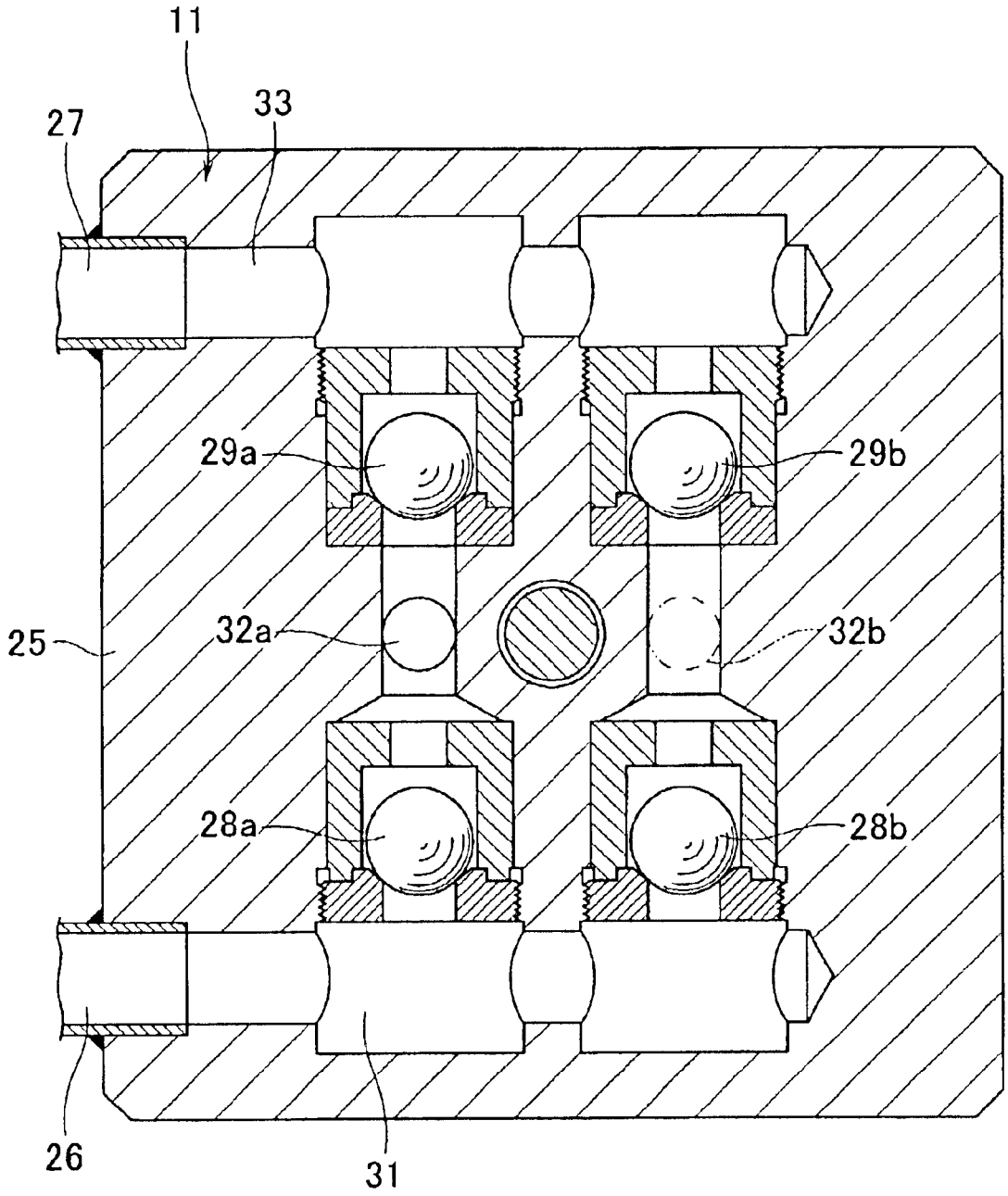
FIG. 2 is a cross-sectional view taken along the A–A' line in FIG. 1.

FIG. 1 is a cross-sectional view showing an arrangement of a pump system according to a first embodiment of the present invention and FIG. 2 is a cross-sectional view taken along the A–A' line in FIG. 1.

This pump system employs switching mechanisms of a cylinder type and comprises a pump 1 and a switching valve mechanism 2 for distributing an air as an actuating fluid into the pump 1.

The pump 1 includes a pair of cylindrical bellows 13*a*, 13*b* composed of flexible members to form pump chambers 12*a*, 12*b* at both sides of a pump head 11. These bellows 13*a*, 13*b* have movable end plates 14*a*, 14*b* linked together via a shaft 15 that passes through the pump head 11. The bellows 13*a*, 13*b* are individually housed in cylindrical cases 16*a*, 16*b* located at both sides of the pump head 11 to form air chambers 17*a*, 17*b* between the inner walls of the cases 16*a*, 16*b* and the outer walls of the bellows 13*a*, 13*b*. The cases 16*a*, 16*b* have stationary ends or opened edges 18*a*, 18*b* fitted in recessed portions in the pump head 11, of which outer surfaces are secured on the pump head 11 when fixing rings 19*a*, 19*b* are screwed in the pump head 11. The bellows 13*a*, 13*b* have stationary ends or opened edges 20*a*,

20*b* fitted in recessed portions in the pump head 11. The outer surfaces thereof are liquid-tightly secured on the pump head 11 when they are pressed beneath the inner steps of the edges 18*a*, 18*b* of the cases 16*a*, 16*b*. The cases 16*a*, 16*b* have main air orifices 21*a*, 21*b* for introducing and discharging airs into and from the air chambers 17*a*, 17*b*.

The pump head 11 includes an inlet 26 and an outlet 27 on a side of the pump head body 25 for a target fluid to be transferred, as shown in FIG. 2, together with a valve unit consisting of four ball valves 28*a*, 28*b*, 29*a*, 29*b*. When the bellows 13*a* extends, the target fluid is sucked from the inlet 26 and introduced into the pump chamber 12*a* via an introduction path 31, the ball valve 28*a* and an orifice 32*a*. The target fluid once introduced into the pump chamber 12*a* is discharged from the outlet 27 via the orifice 32*a*, the ball valve 29*a* and a discharge path 33 when the bellows 13*a* contracts. When the bellows 13*b* extends, the target fluid is sucked from the inlet 26 and introduced into the pump chamber 12*b* via the introduction path 31, the ball valve 28*b* and an orifice 32*b*. The target fluid once introduced into the pump chamber 12*b* is discharged from the outlet 27 via the orifice 32*b*, the ball valve 29*b* and the discharge path 33 when the bellows 13*b* contracts.

The cases 16*a*, 16*b* have closed ends, to which switching mechanisms 40*a*, 40*b* are detachably attached. The switching mechanisms 40*a*, 40*b* include cylindrical cases 41*a*, 41*b* fixedly and detachably screwed to the cases 16*a*, 16*b* from outside; cylinders 42*a*, 42*b* coaxially housed in these cylindrical cases 41*a*, 41*b*; and rods 43*a*, 43*b* capable of reciprocating in the axial direction within these cylinders 42*a*, 42*b*. The cylindrical cases 41*a*, 41*b* have pilot air orifices 44*a*, 44*b*, 45*a*, 45*b* at ends and sidewalls for introducing and discharging pilot airs or control fluids. The cylinders 42*a*, 42*b* have openings at both ends and holes 46*a*, 46*b* in the sidewalls to communicate with the pilot air orifices 45*a*, 45*b* in the cylindrical cases 41*a*, 41*b*. The rods 43*a*, 43*b* have tips, passing through the cases 16*a*, 16*b*, facing to the air chambers 17*a*, 17*b* and contacting with the end plates 14*a*, 14*b* of the bellows 13*a*, 13*b*, and can reciprocate along with the reciprocation of the end plates 14*a*, 14*b*. The rods 43*a*, 43*b* have bores 47*a*, 47*b* formed in the axial direction extending from the base ends to the tips. The bores 47*a*, 47*b* have top portions communicating with holes 48*a*, 48*b* formed in the sidewalls. The holes 48*a*, 48*b* communicate with the holes 46*a*, 46*b* at certain locations immediately before the rods 43*a*, 43*b* move back most within the cylinders 42*a*, 42*b*. The cylindrical cases 41*a*, 41*b* have air escaping holes 49*a*, 49*b* formed therein and branched from the pilot air orifices 45*a*, 45*b*. The cases 16*a*, 16*b* have lip seals 51*a*, 51*b* formed at the parts that slidably contact with the tip sides of the rods 43*a*, 43*b*. Cylindrical spaces are formed between the inner walls of the cylinders 42*a*, 42*b* and the outer circumferences of the tips of the rods 43*a*, 43*b*. The cylindrical spaces are in communication with air escaping holes 52*a*, 52*b* formed in the cases 16*a*, 16*b*.

The switching valve mechanism 2 includes a switching valve mechanism body 62 that contains an air distribution chamber 61 formed therein. It also includes a spool (switching valve) 63 located in the switching valve mechanism body 62 so that it can reciprocate within the distribution chamber 61. In the switching valve mechanism body 62, an air introduction orifice (introduction orifice) 64 is formed to introduce an air into the distribution chamber 61. Main air orifices (actuating fluid orifices) 65*a*, 65*b* are formed to discharge the air once introduced into the distribution chamber 61 to the pump 1 and introduce the air discharged from the pump 1 into the distribution chamber 61. Main air discharge orifices 66*a*, 66*b* are formed to discharge the air discharged from the pump 1 and introduced into the distribution chamber 61. Pilot air orifices (control fluid orifices) 67*a*, 67*b* are formed to introduce and discharge pilot airs. The spool 63 has three large-diameter portions formed at a certain interval in the axial direction, which are employed to selectively close holes arrange around the portions to switch airflow paths between first and second states. The first state is such a mode that a pilot air is introduced through the pilot air orifice 67*a*. In this mode, the air introduction orifice 64 is in communication with the main air orifice 65*a* and the main air orifice 65*b* in communication with the main air discharge orifice 66*b*. The second state is such a mode that a pilot air is introduced through the pilot air orifice 67*b*. In this mode, the air introduction orifice 64 is in communication with the main air orifice 65*b* and the main air orifice 65*a* in communication with the main air discharge orifice 66*a*.

An air source 71 is employed to supply an air, which is introduced via a regulator 72 and an air introduction conduit 73 into the air introduction orifice 64 in the switching valve mechanism 2. The main air orifice 65*a* in the switching valve mechanism 2 is connected to the main air orifice 21*a* in the case 16*a* via a main air conduit (main conduit) 74*a*. The main air orifice 65*b* in the switching valve mechanism 2 is connected to the main air orifice 21*b* in the case 1 6*b* via a main air conduit (main conduit) 74*b*. The main air conduits (main conduits) 74*a*, 74*b* are connected to pilot air-pressure introduction conduits (introduction path) 75*a*, 75*b*, which pilot air-pressure introduction conduits 75*a*, 75*b* are connected to the pilot air orifices 44*a*, 44*b* in the switching mechanisms 40*a*, 40*b*. At the connected points between the pilot air orifices 44*a*, 44*b* and the pilot air-pressure introduction conduits 75*a*, 75*b*, throttles 76*a*, 76*b* are located to adjust amounts of the pilot airs introduced into the switching mechanisms 40*a*, 40*b*. The pilot air orifices 45*a*, 45*b* in the switching mechanisms 40*a*, 40*b* are connected to pilot air orifices 67*a*, 67*b* in the switching valve mechanism 2 via pilot air conduits (control fluid conduits) 77*a*, 77*b*. Air pools 50*a*, 50*b* are formed in the pilot air conduits 77*a*, 77*b* at the sides near the pilot air orifices 45*a*, 45*b*.

Operations of the pump system thus configured according to this embodiment will be described next.

In FIG. 1, the spool 63 in the switching valve mechanism 2 is located at the left side in the figure in the first state. In this state, the air supplied from the air source 71 is introduced via the main air conduit 74*a* into the air chamber 17*a* in the pump 1 at the left side in the figure. As a result, the bellows 13*a* contracts to move the shaft 15 toward the right side in the figure. Accordingly, the bellows 13*b* extends to discharge the air in the air chamber 17*b* to external via the main air conduit 74*b*, the main air orifice 65*b* and the air discharge orifice 66*b*. Consequently, the target fluid is introduced into the pump chamber 12*b* via the inlet 26 and the target fluid in the pump chamber 12*a* is discharged to external via the outlet 27. At the same time, the pilot air is introduced into the switching mechanism 40*b* via the pilot air-pressure introduction conduit 75*a* branched from the main air conduit 74*a* to elevate the pressure inside the bore 47*b* in the rod 43*b*.

Immediately before the bellows 13*b* reaches the terminal position in the suction process, the hole 48*b* in the rod 43*b* communicates with the bore 46*b* in the cylinder 42*b*. As a result, the compressed pilot air is introduced into the switching valve mechanism 2 via the pilot air conduit 77*b* to move the spool 63 toward the right side in the figure and shift the system to the second state.

In the second state, the air supplied from the air source 71 is introduced via the main air conduit 74*b* into the air chamber 17*b* in the pump 1 at the right side in the figure. As a result, the bellows 13*b* contracts to move the shaft 15 toward the left side in the figure. Accordingly, the bellows 13*a* extends to discharge the air in the air chamber 17*a* to external via the main air conduit 74*a*, the main air orifice 65*a* and the air discharge orifice 66*a*. Consequently, the target fluid is introduced into the pump chamber 12*a* via the inlet 26 and the target fluid in the pump chamber 12*b* is discharged to external via the outlet 27. At the same time, the pilot air is introduced into the switching mechanism 40*a* via the pilot air-pressure introduction conduit 75*b* branched from the main air conduit 74*b* to elevate the pressure inside the bore 47*a* in the rod 43*a*. Immediately before the bellows 13*a* reaches the terminal position in the suction process, the hole 48*a* in the rod 43*a* communicates with the bore 46*a* in the cylinder 42*a*. As a result, the compressed pilot air is introduced into the switching valve mechanism 2 via the pilot air conduit 77*a* to move the spool 63 toward the left side in the figure and the system returns to the first state.

Through the repetition of the above operations to extend and contract the bellows 13*a*, 13*b*, the liquid can be transferred continuously.

Annular spaces are present in between the tips of the rods 43*a*, 43*b* and the cylinders 42*a*, 42*b* in the switching mechanisms 40*a*, 40*b*. In relation to the presence of the lip seals 51*a*, 51*b*, these annular spaces are pressurized/evacuated in accordance with reciprocation of the rods 43*a*, 43*b*. The occurrence of such the pressurization/evacuation prevents the rods 43*a*, 43*b* from smoothly moving back and forth. The air escaping holes 52*a*, 52*b* are thus formed in the cases 16*a*, 16*b* to allow the spaces between the tips of the rods 43*a*, 43*b* and the cylinders 42*a*, 42*b* to communicate with external. This is effective to smoothly move the rods 43*a*, 43*b* back and forth.

If the pilot air has an excessive amount, air leakage through clearances between the cylinders 42*a*, 42*b* and the rods 43*a*, 43*b* may possibly cause a malfunction in the switching valve mechanism 2. If the pilot air has an excessive amount, when pressures inside the bores 47*a*, 47*b* in the rod 43*a*, 43*b* elevate, air leakage may possibly cause a malfunction in the switching valve mechanism 2. This air leakage is caused during a transient time from the communication state between the holes 48*a*, 48*b* in the rods 43*a*, 43*b* and the holes 46*a*, 46*b* in the cylinders 42*a*, 42*b* to the non-communication state after the rods 43*a*, 43*b* move. In this embodiment, the throttles 76*a*, 76*b* are located at the pilot air orifices 44*a*, 44*b* in the switching mechanisms 40*a*, 40*b* to limit amounts of the compressed airs from the pilot air-pressure introduction conduit 75*a*, 75*b*. This is effective to stabilize operations. The above malfunction may be prevented by the air pools 50*a*, 50*b* located in the pilot air conduits 77*a*, 77*b* to delay the introduction of the pilot air. In this embodiment, to prevent a malfunction in the switching valve mechanism 2 due to residual air pressures in the pilot air conduits 77*a*, 77*b*, the air escaping holes 49*a*, 49*b* are employed to remove the residual pressures.

According to the pump system, all components can be composed of non-metallic materials such as resins for the pump head 11, cases 16*a*, 16*b* and bellows 13*a*, 13*b* and ceramics for the shaft 15 and switching mechanisms 40*a*, 40*b*. Thus, it is possible to provide a pump system that is excellent in anti-corrosion and available even in an environment for transferring a corrosive chemical liquid. The switching mechanisms 40*a*, 40*b* can be removed entirely by screwing off because the rods 43*a*, 43*b* are not coupled to the end plates 14*a*, 14*b* of the bellows 13*a*, 13*b*. Thus, it is possible to provide a pump system that is excellent in the maintenance ability and easy to replace and repair the switching mechanisms 40*a*, 40*b*.

Second Embodiment

Figure 3:
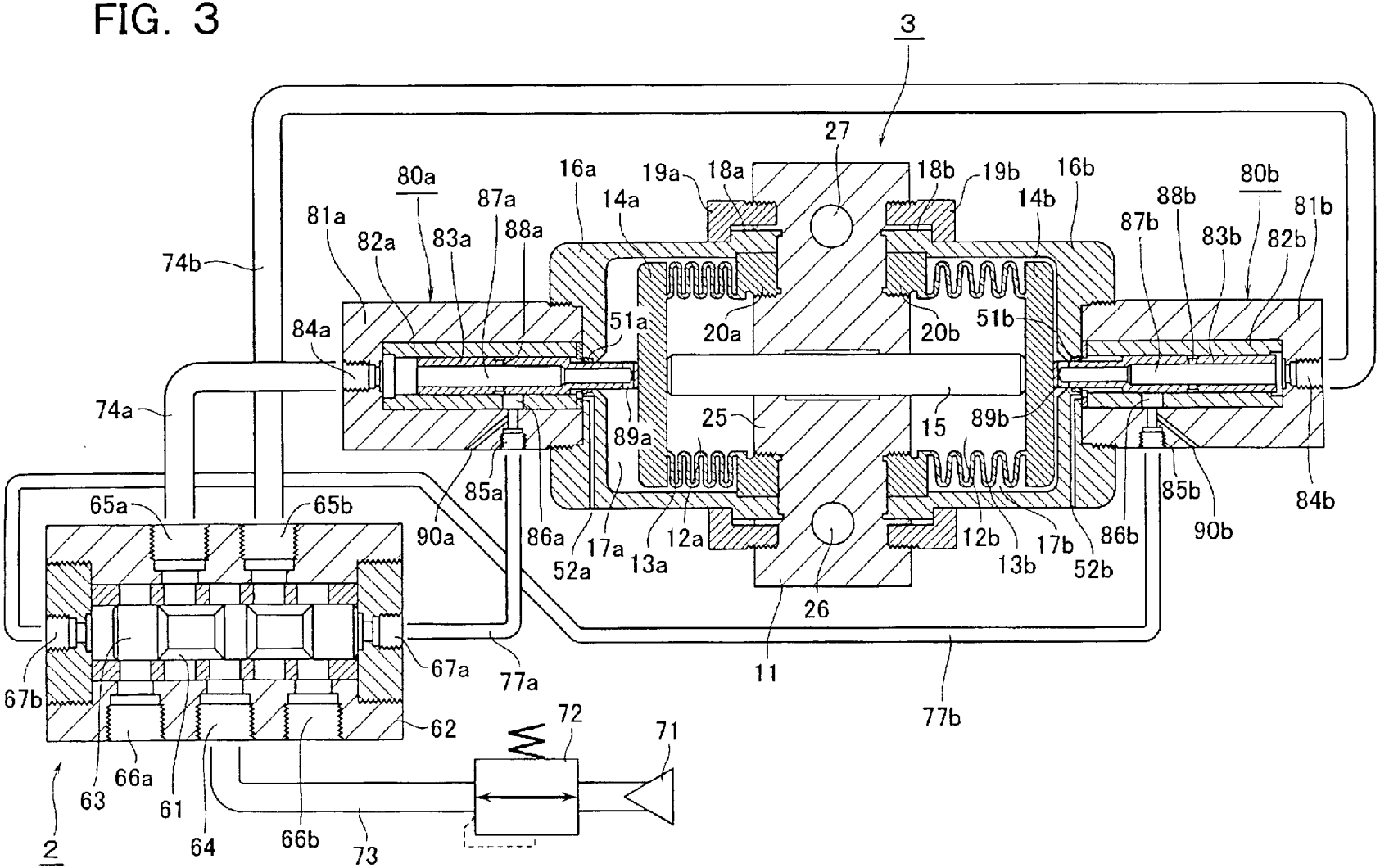
FIG. 3 is a cross-sectional view showing an arrangement of a pump system according to a second embodiment of the present invention.

FIG. 3 is a cross-sectional view showing an arrangement of a pump system according to a second embodiment of the present invention. The same reference numerals are given to the almost same parts in FIG. 3 as those in FIG. 1 to omit duplication of the detailed description on the same parts.

The pump system according to this embodiment comprises a pump 3 and a switching valve mechanism 2. Switching mechanisms 80*a*, 80*b* detachably attached to the pump 3 are different from the switching mechanisms 40*a*, 40*b* in the first embodiment. The pump system according to the first embodiment is operative to turn on one of the switching mechanisms 40*a*, 40*b* having the rods 43*a*, 43*b* pressed by the bellows 13*a*, 13*b* immediately before the end of the suction process to supply the pilot air to the switching valve mechanism 2. To the contrary, the second embodiment is operative to turn on one of the switching mechanisms 80*a*, 80*b* having rods pressing the bellows 13*a*, 13*b* from behind immediately before the end of the suction process to supply the pilot air to the switching valve mechanism 2.

The switching mechanisms 80*a*, 80*b* are detachably attached to the closed ends of the cases 16*a*, 16*b*. The switching mechanisms 80*a*, 80*b* include cylindrical cases 81*a*, 81*b* fixedly and detachably screwed to the cases 16*a*, 16*b* from outside; cylinders 82*a*, 82*b* coaxially housed in these cylindrical cases 81*a*, 81*b*; and rods 83*a*, 83*b* capable of reciprocating in the axial direction within these cylinders 82*a*, 82*b*. The cylindrical cases 81*a*, 81*b* have main air orifices 84*a*, 84*b* at the ends for introducing and discharging main airs or actuating fluids and pilot air orifices 85*a*, 85*b* in sidewalls for introducing and discharging pilot airs or control fluids. The cylinders 82*a*, 82*b* have openings at both ends and holes 86*a*, 86*b* in the sidewalls to communicate with pilot air orifices 85*a*, 85*b* in the cylindrical cases 81*a*, 81*b*. The rods 83*a*, 83*b* have tips, passing through the cases 16*a*, 16*b*, facing to the air chambers 17*a*, 17*b* and contacting with the end plates 14*a*, 14*b* of the bellows 13*a*, 13*b*, and can reciprocate along with the reciprocation of the end plates 14*a*, 14*b*. The rods 83*a*, 83*b* have bores 87*a*, 87*b* formed in the axial direction extending from the base ends to the tips. The bores 87*a*, 87*b* have mid-portions and top portions communicating with holes 88*a*, 88*b* and 89*a*, 89*b* formed in the sidewalls at the mid-portions and top portions. The holes 88*a*, 88*b* communicate with the holes 86*a*, 86*b* at certain locations immediately before the rods 83*a*, 83*b* advance most within the cylinders 82*a*, 82*b*. The holes 89*a*, 89*b* are located inside the air chambers 17*a*, 17*b*. The cases 16*a*, 16*b* have lip seals 51*a*, 51*b* formed at the parts that slidably contact with the tip sides of the rods 83*a*, 83*b*. Cylindrical spaces are formed in between the inner walls of the cylinders 82*a*, 82*b* and the outer circumferences of the tips of the rods 83*a*, 83*b*. The cylindrical spaces are in communication with air escaping holes 52*a*, 52*b* formed in the cases 16*a*, 16*b*. The cylindrical cases 81*a*, 81*b* have air escaping holes 90*a*, 90*b* formed therein and branched from the pilot air orifices 85*a*, 85*b*.

This embodiment is not provided with the pilot air-pressure induction conduits 75*a*, 75*b* employed in the first embodiment. Instead, the main air conduits 74*a*, 74*b* are connected to the main air orifices 84*a*, 84*b* in the switching mechanisms 80*a*, 80*b*.

This embodiment places the main air orifices 65*a*, 65*b* and the air discharge orifices 66*a*, 66*b* in the switching valve mechanism 2 in a positional relation opposite to the previous embodiment.

Operations of the pump system thus configured according to this embodiment will be described next.

In FIG. 3, the spool 63 in the switching valve mechanism 2 is located at the right side in the figure in the first state. In this state, the air supplied from the air source 71 is introduced via the main air conduit 74*a* and the holes 87*a*, 89*a* formed in the rod 83*a* in the switching mechanism 80*a* into the air chamber 17*a* in the pump 1 at the left side in the figure. At the same time, the pressure of the main air drives the rod 83*a* forward. The pressure of the main air contracts the bellows 13*a* to move the shaft 15 toward the right side in the figure. Accordingly, the bellows 13*b* extends to discharge the air in the air chamber 17*b* to external via the holes 89*b*, 87*b* in the rod 83*b* in the switching mechanism 80*a*, the main air conduit 74*b*, the main air orifice 65*b* and the air discharge orifice 66*b*. Consequently, the target fluid is introduced into the pump chamber 12*b* via the inlet 26 and the target fluid in the pump chamber 12*a* is discharged to external via the outlet 27.

Immediately before the bellows 13*a* reaches the terminal position in the discharge process, the hole 88*a* in the rod 83*a* communicates with the hole 86*a* in the cylinder 82*a*. As a result, the pilot air branched from the main air is introduced into the switching valve mechanism 2 via the pilot air conduit 77*a* to move the spool 63 toward the left side in the figure and shift the system to the second state.

In the second state, the air supplied from the air source 71 is introduced via the main air conduit 74*b* and the holes 87*b*, 89*b* formed in the rod 83*b* in the switching mechanism 80*b* into the air chamber 17*b* in the pump 1 at the right side in the figure. At the same time, the pressure of the main air drives the rod 83*b* forward. The pressure of the main air contracts the bellows 13*a* to move the shaft 15 toward the left side in the figure. Accordingly, the bellows 13*a* extends to discharge the air in the air chamber 17*a* to external via the holes 89*a*, 87*a* in the rod 83*a* in the switching mechanism 80*a*, the main air conduit 74*a*, the main air orifice 65*a* and the air discharge orifice 66*a*. Consequently, the target fluid is introduced into the pump chamber 12*b* via the inlet 26 and the target fluid in the pump chamber 12*a* is discharged to external via the outlet 27. Immediately before the bellows 13*b* reaches the terminal position in the discharge process, the hole 88*b* in the rod 83*b* communicates with the hole 86*a* in the cylinder 82*a*. As a result, the compressed pilot air is introduced into the switching valve mechanism 2 via the pilot air conduit 77*b* to move the spool 63 toward the right side in the figure and shift the system back to the first state.

Through the repetition of the above operations to extend and contract the bellows 13*a*, 13*b*, the liquid can be transferred continuously.

In this embodiment, to prevent a malfunction in the switching valve mechanism 2 due to residual air pressures in the pilot air conduits 77*a*, 77*b*, the air escaping holes 90*a*, 90*b* are employed to remove the residual pressures.

Third Embodiment

Figure 4:
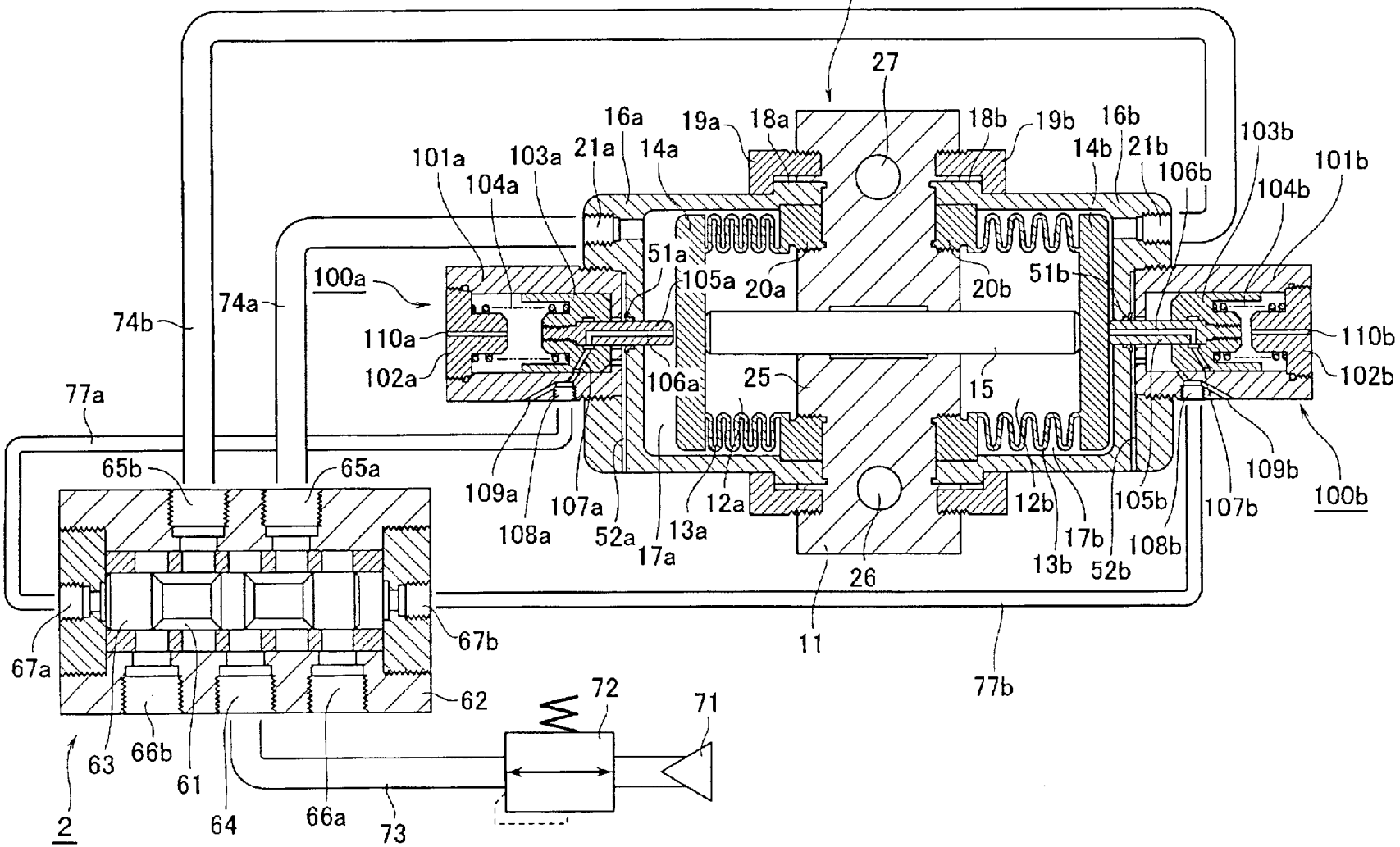
FIG. 4 is a cross-sectional view showing an arrangement of a pump system according to a third embodiment of the present invention.

FIG. 4 is a cross-sectional view showing an arrangement of a pump system according to a third embodiment of the present invention. The same reference numerals are given to the almost same parts in FIG. 4 as those in FIG. 1 to omit duplication of the detailed description on the same parts.

The pump system according to this embodiment comprises a pump 4 and a switching valve mechanism 2. Switching mechanisms 100*a*, 100*b* detachably attached to the pump 4 are different from the switching mechanisms 40*a*, 40*b*, 80*a*, 80*b* in the first and second embodiments. In the pump system according to the first and second embodiments, the switching mechanisms 40*a*, 40*b*, 80*a*, 80*b* are of cylinder types. To the contrary, in the third embodiment, they are of types using springs.

The switching mechanisms 100*a*, 100*b* are detachably attached to the closed ends of the cases 16*a*, 16*b*. The switching mechanisms 100*a*, 100*b* include cylindrical cases 110*a*, 101*b* fixedly and detachably screwed to the cases 16*a*, 16*b* from outside. Spring retaining screws 102*a*, 102*b* are fastened to the base end of these cylindrical cases 110*a*, 101*b*. Rings 103*a*, 103*b* are housed in the cylindrical cases 101*a*, 101*b* movably in the axial direction. Springs 104*a*, 104*b* are located in between the spring retaining screws 102*a*, 102*b* and the rings 103*a*, 103*b* to always drive the rings 103*a*, 103*b* toward the bellows 13*a*, 13*b*. Rods 105*a*, 105*b* are secured in the rings 103*a*, 103*b* to move back and forth together with the rings 103*a*, 103*b*. The rods 105*a*, 105*b* have tips facing to the air chambers 17*a*, 17*b* and bores 106*a*, 106*b* extending in the axial direction to communicate with the tips. The bores 106*a*, 106*b* have base ends in communication with holes 107*a*, 107*b* formed in the sidewalls of the rings 103*a*, 103*b*. Pilot air orifices 108*a*, 108*b* are formed in the sidewalls of the cylindrical cases 101*a*, 101*b* for introducing and discharging pilot airs or control fluids. They communicate with the holes 107*a*, 107*b* in the rings 103*a*, 103*b* when the rods 105*a*, 105*b* protrude most. The cylindrical cases 101*a*, 101*b* have air escaping holes 109*a*, 109*b* formed therein and branched from the pilot air orifices 108*a*, 108*b*. The springs 104*a*, 104*b* may be made of stainless steel and covered with a PFA or PTFE tube or applied with fluorine coating to possibly improve anti-corrosion.

This embodiment is not provided with the pilot air-pressure induction conduits 75*a*, 75*b* employed in the first embodiment. This embodiment places the pilot air orifices 67*a*, 67*b* in the switching valve mechanism 2 in a positional relation opposite to the previous embodiments.

Operations of the pump system thus configured according to this embodiment will be described next.

In FIG. 4, the spool 63 in the switching valve mechanism 2 is located at the left side in the figure in the first state. In this state, the air supplied from the air source 71 is introduced via the main air conduit 74*a* into the air chamber 17*a* in the pump 1 at the left side in the figure. As a result, the bellows 13*a* contracts to move the shaft 15 toward the right side in the figure. Accordingly, the bellows 13*b* extends to discharge the air in the air chamber 17*b* to external via the main air conduit 74*b*, the main air orifice 65*b* and the air discharge orifice 66*b*. Consequently, the target fluid is introduced into the pump chamber 12*b* via the inlet 26 and the target fluid in the pump chamber 12*a* is discharged to external via the outlet 27.

Immediately before the bellows 13*a* reaches the terminal position in the discharge process, the tip of the rod 105*a* separates from the end plate 14*a* of the bellows 13*a*. As a result, the hole 106*a* at the tip of the rod 105*a* is opened Then, the compressed air in the air chamber 17*a* is introduced into the switching valve mechanism 2 via the holes 106*a*, 107*a*, the pilot air orifice 108*a* and the pilot air conduit 77*a* to move the spool 63 toward the left side in the figure and shift the system to the second state.

In this second state, the air supplied from the air source 71 is introduced via the main air conduit 74*b* into the air chamber 17*b* in the pump 1 at the right side in the figure. As a result, the bellows 13*b* contracts to move the shaft 15 toward the left side in the figure. Accordingly, the bellows

13*a* extends to discharge the air in the air chamber 17*a* to external via the main air conduit 74*a*, the main air orifice 65*a* and the air discharge orifice 66*a*. Consequently, the target fluid is introduced into the pump chamber 12*a* via the inlet 26 and the target fluid in the pump chamber 12*b* is discharged to external via the outlet 27.

Immediately before the bellows 13*b* reaches the terminal position in the discharge process, the tip of the rod 105*b* separates from the end plate 14*b* of the bellows 13*b*. As a result, the hole 106*b* at the tip of the rod 105*b* is opened. Then, the compressed air in the air chamber 17*b* is introduced into the switching valve mechanism 2 via the holes 106*b*, 107*b*, the pilot air orifice 108*b* and the pilot air conduit 77*b* to move the spool 63 toward the left side in the figure and shift the system back to the first state.

Through the repetition of the above operations to extend and contract the bellows 13*a*, 13*b*, the liquid can be transferred continuously.

In this embodiment, the cylindrical cases 101*a*, 101*b* are pressurized/evacuated in accordance with reciprocation of the rings 103*a*, 103*b*. The air escaping holes 52*a*, 52*b* are thus formed in the cases 16*a*, 16*b* and air escaping holes 110*a*, 110*b* are also formed in the retaining screws 102*a*, 102*b* to prevent such the pressurization/evacuation from occurring.

Fourth Embodiment

Figure 5:
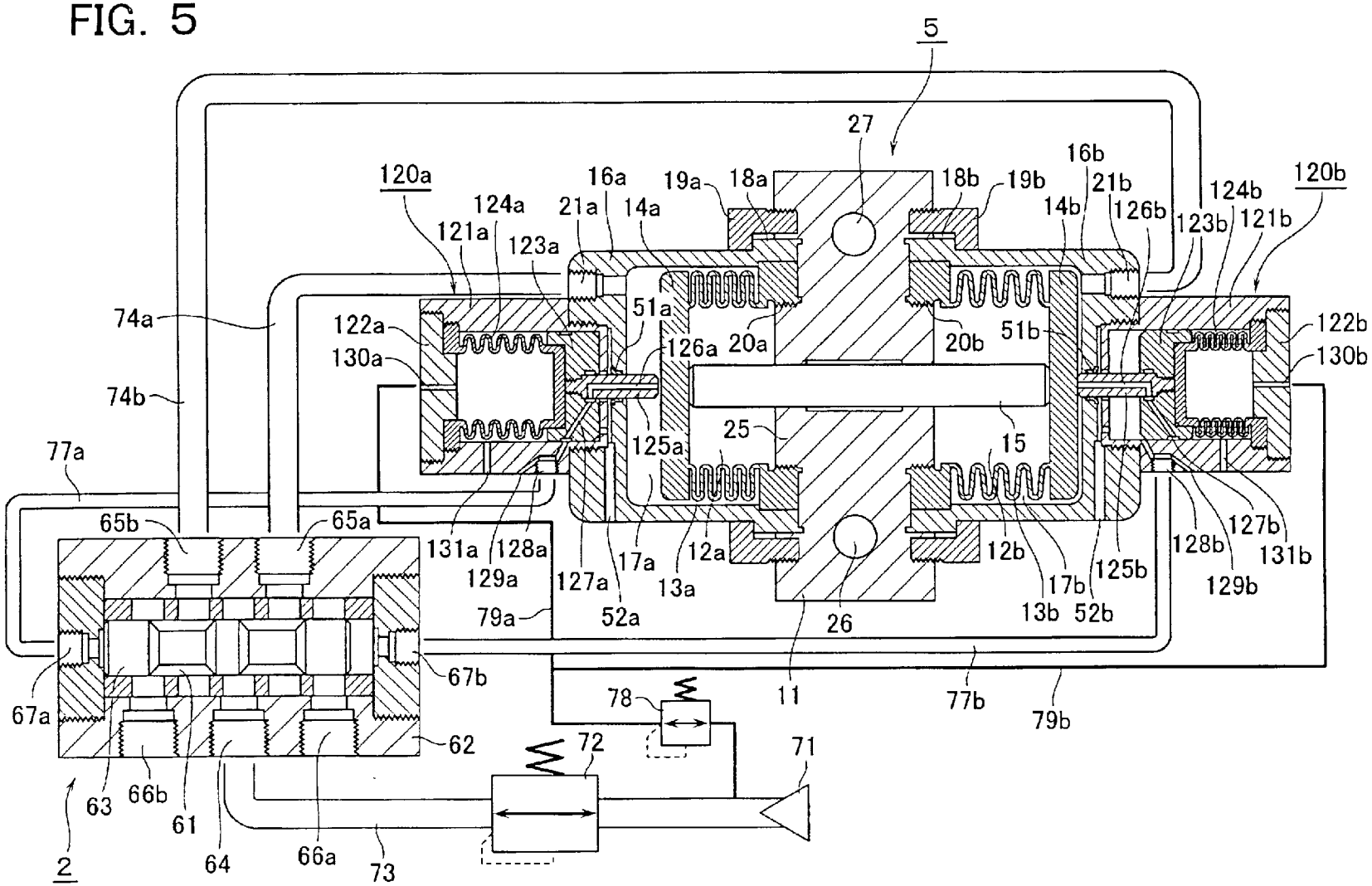
FIG. 5 is a cross-sectional view showing an arrangement of a pump system according to a fourth embodiment of the present invention.

FIG. 5 is a cross-sectional view showing an arrangement of a pump system according to a fourth embodiment of the present invention. The same reference numerals are given to the almost same parts in FIG. 5 as those in FIG. 1 to omit duplication of the detailed description on the same parts.

The pump system according to this embodiment comprises a pump 5 and a switching valve mechanism 2. This embodiment employs bellows in switching mechanisms 120*a*, 120*b* while the previous embodiment employs the springs 104*a*, 104*b* in the switching mechanisms 100*a*, 100*b*.

The switching mechanisms 120*a*, 120*b* are detachably attached to the closed ends of the cases 16*a*, 16*b*. The switching mechanisms 120*a*, 120*b* include cylindrical cases 121*a*, 121*b* fixedly and detachably screwed to the cases 16*a*, 16*b* from outside. Bellows retaining screws 122*a*, 122*b* are fastened to the base end of these cylindrical cases 121*a*, 121*b*. Rings 123*a*, 123*b* are housed in the cylindrical cases 121*a*, 121*b* movably in the axial direction. Bellows 124*a*, 124*b* are located in between the retaining screws 122*a*, 122*b* and the rings 123*a*, 123*b* to always drive the rings 123*a*, 123*b* toward the bellows 13*a*, 13*b*. Rods 125*a*, 125*b* are secured in the rings 123*a*, 123*b* to move back and forth together with the rings 123*a*, 123*b*. The rods 125*a*, 125*b* have tips facing to the air chambers 17*a*, 17*b* and bores 126*a*, 126*b* extending in the axial direction to communicate with the tips. The bores 126*a*, 126*b* have base ends in communication with holes 127*a*, 127*b* formed in the sidewalls of the rings 123*a*, 123*b*. Pilot air orifices 128*a*, 128*b* are formed in the sidewalls of the cylindrical cases 121*a*, 121*b* for introducing and discharging pilot airs or control fluids. They communicate with the holes 127*a*, 127*b* in the rings 123*a*, 123*b* when the rods 125*a*, 125*b* protrude most. The cylindrical cases 121*a*, 121*b* have air escaping holes 129*a*, 129*b* formed therein and branched from the pilot air orifices 128*a*, 128*b*.

Detailed operations are almost similar to those of the third embodiment and accordingly omitted to describe the contents. It is required to always fill the bellows 124*a*, 124*b* with air compressed under an appropriate pressure. Holes 130*a*, 130*b* are thus formed in the retaining screws 122*a*, 122*b*. In addition, the air supplied from the air source 71 is pressurized at a bellows-pressurizing regulator 78 to supply a pressurizing air to the bellows 124*a*, 124*b* via bellows-pressurizing conduits 79*a*, 79*b* and the holes 130*a*, 130*b*.

Fifth Embodiment

Figure 6:
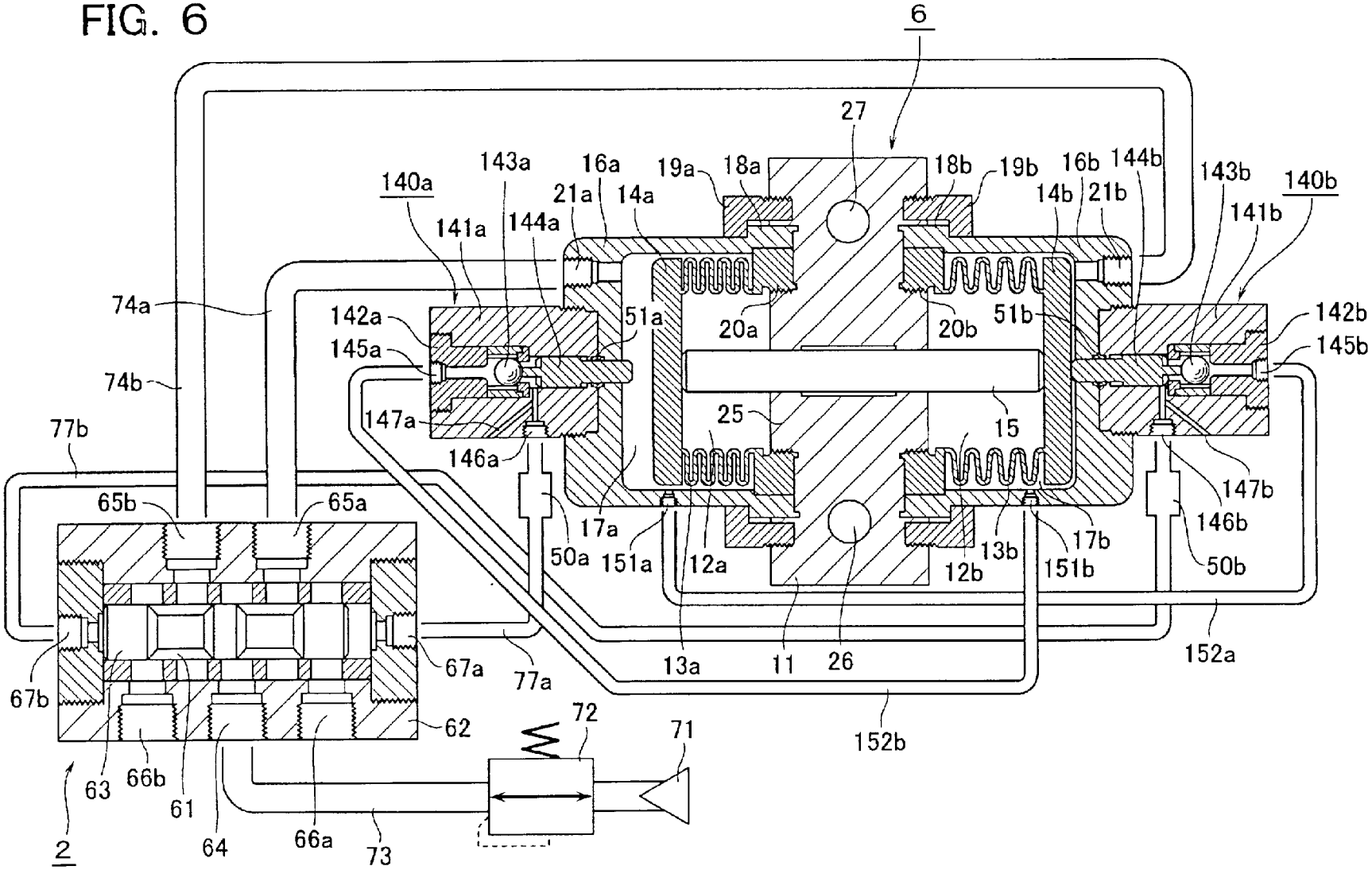
FIG. 6 is a cross-sectional view showing an arrangement of a pump system according to a fifth embodiment of the present invention.

FIG. 6 is a cross-sectional view showing an arrangement of a pump system according to a fifth embodiment of the present invention. The same reference numerals are given to the almost same parts in FIG. 6 as those in FIG. 1 to omit duplication of the detailed description on the same parts.

The pump system according to this embodiment comprises a pump 6 and a switching valve mechanism 2. Switching mechanisms 140*a*, 140*b* detachably attached to the pump 6 are of a ball valve type.

The switching mechanisms 140*a*, 140*b* are detachably screwed to the cases 16*a*, 16*b* from outside and include cylindrical cases 141*a*, 141*b*. Ball-valve retaining screws 142*a*, 142*b* are fastened to the base end of these cylindrical cases 141*a*, 141*b*. Ball valves 143*a*, 143*b* are housed in the cylindrical cases 141*a*, 141*b* and secured by the retaining screws 142*a*, 142*b*. Rods 144*a*, 144*b* are housed in the front portions of the cylindrical cases 141*a*, 141*b* and move back and forth. The rods 144*a*, 144*b* have tips facing to the air chambers 17*a*, 17*b* and base ends for opening/closing the ball valves 143*a*, 143*b*. Pilot air introduction orifices 145*a*, 145*b* are formed in the retaining screws 142*a*, 142*b* to communicate with the air introduction side of the ball valves 143*a*, 143*b*. Formed in the sidewalls of the cylindrical cases 141*a*, 141*b* are pilot air orifices 146*a*, 146*b* in communication with the air discharge side of the ball valves 143*a*, 143*b* and air escaping holes 147*a*, 147*b* branched from the pilot air orifices 146*a*, 146*b*.

Pilot air discharge orifices 151*a*, 151*b* are formed in the sidewalls of the cases 16*a*, 16*b* in the pump 6. These pilot air discharge orifices 151*a*, 151*b* are connected to the pilot air introduction orifices 145*a*, 145*b* via pilot air introduction conduits 152*a*, 152*b*.

Operations of the pump system thus configured according to this embodiment will be described next.

In FIG. 6, the spool 63 in the switching valve mechanism 2 is located at the left side in the figure in the first state. In this state, the air supplied from the air source 71 is introduced via the main air conduit 74*a* into the air chamber 17*a* in the pump 1 at the left side in the figure. As a result, the bellows 13*a* contracts to move the shaft 15 toward the right side in the figure. Accordingly, the bellows 13*b* extends to discharge the air in the air chamber 17*b* to external via the main air conduit 74*b*, the main air orifice 65*b* and the air discharge orifice 66*b*. Consequently, the target fluid is introduced into the pump chamber 12*b* via the inlet 26 and the target fluid in the pump chamber 12*a* is discharged to external via the outlet 27. At the same time, the pressurized air in the air chamber 17*a* is introduced as the pilot air into the switching mechanism 140*b* via the pilot air discharge orifice 151*a*, the pilot air introduction conduit 152*a* and the pilot air introduction orifice 145*b* to close the ball valve 143*b*.

Immediately before the bellows 13*b* reaches the terminal position in the suction process, the base end of the rod 144*b* pushes up the ball in the ball valve 143*b* to open the ball valve 143*b*. As a result, the compressed pilot air introduced into the switching mechanism 140*b* is introduced into the switching valve mechanism 2 via the pilot air orifice 146*a* and the pilot air conduit 77*b* to move the spool 63 toward the right side in the figure and shift the system to the second state.

Similarly, in the second state, the pilot air compressed through the switching mechanism 140*a* is introduced into the switching valve mechanism 2 via the pilot air conduit 77*a* to move the spool 63 toward the left side in the figure and shift the system back to the first state.

Through the repetition of the above operations to extend and contract the bellows 13*a*, 13*b*, the liquid can be transferred continuously.

Also in this embodiment, to prevent a malfunction in the switching valve mechanism 2 due to residual air pressures in the pilot air conduits 77*a*, 77*b*, the air escaping holes 147*a*, 147*b* are employed to remove the residual pressures.

In this embodiment, if it takes a long time until the ball valves 143*a*, 143*b* are closed after the introduction of the pilot air into the switching mechanisms 140*a*, 140*b* from the pilot air introduction conduits 152*a*, 152*b*, leakage of the pilot air may cause a malfunction. Therefore, the pilot air introduction conduits 152*a*, 152*b* are connected to the main air conduits 74*a*, 74*b* not directly but once through the air chambers 17*a*, 17*b*. This is operative to cause a primary delay in the pilot air toward the switching mechanisms 140*a*, 140*b* to prevent the leakage of the pilot air. The above malfunction may be prevented by the air pools 50*a*, 50*b* located in the pilot air conduits 77*a*, 77*b* to delay the introduction of the pilot air.

Sixth Embodiment

Figure 7:
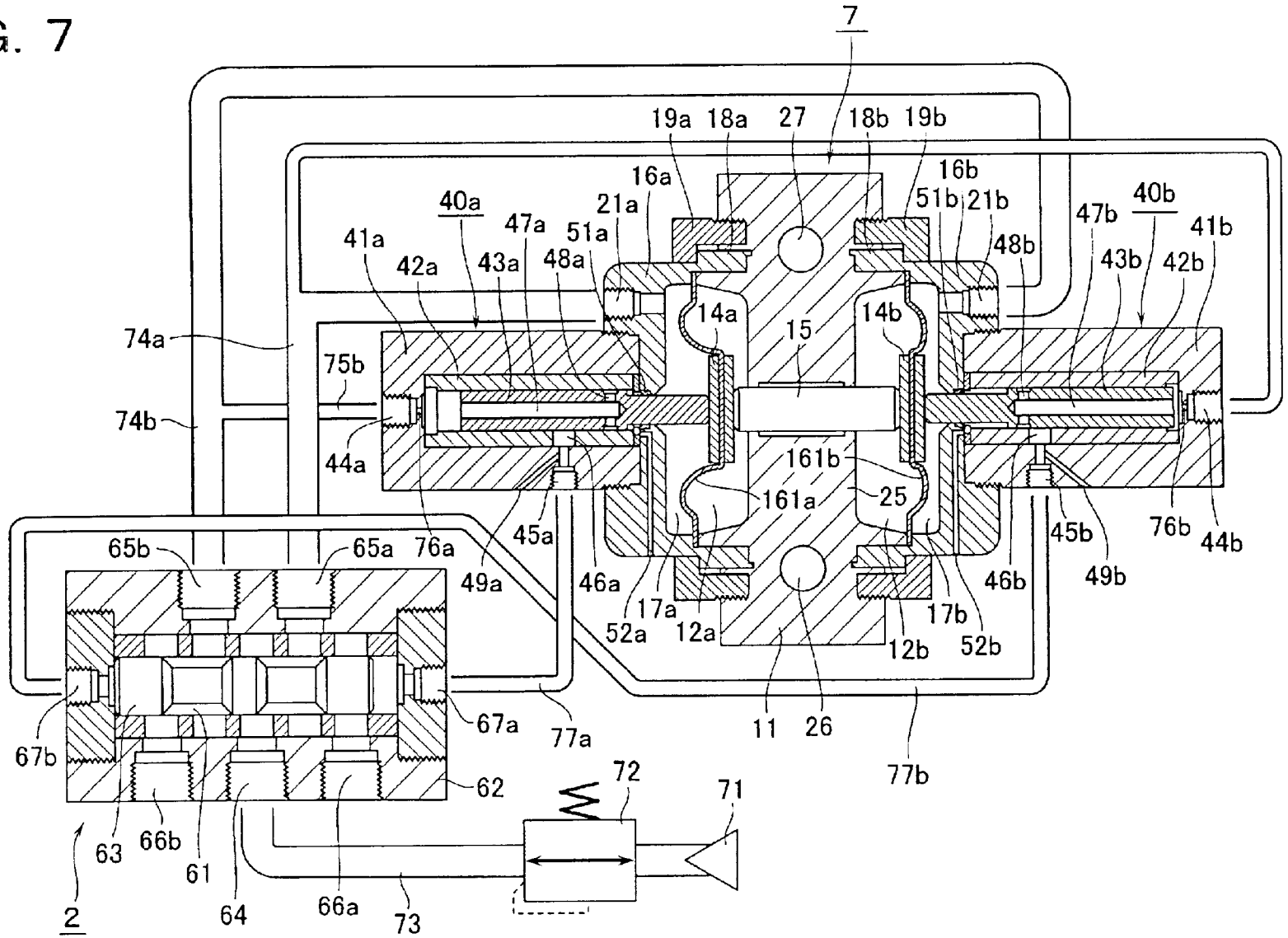
FIG. 7 is a cross-sectional view showing an arrangement of a pump system according to a sixth embodiment of the present invention.

FIG. 7 is a cross-sectional view showing an arrangement of a pump system according to a sixth embodiment of the present invention. The same reference numerals are given to the almost same parts in FIG. 7 as those in FIG. 1 to omit duplication of the detailed description on the same parts.

This embodiment employs a pump 7 of a diaphragm type instead of the pump 1 of the bellows type of the embodiment shown in FIG. 1.

The pump 7 employs diaphragms 161*a*, 161*b* as flexible members instead of the bellows 13*a*, 13*b* in the pump 1 of FIG. 1. Except for this point, other arrangement is same as that of the pump 1 and accordingly omitted to describe in detail.

As obvious from the above, according to the present invention, in the pump system of the type that employs the control fluid branched from the actuating fluid to switch the switching valve mechanism, the switching mechanism for branching the actuating fluid is detachably attached to the case from outside. In addition, the movable member reciprocating together with the shaft is not fixed to the shaft. Therefore, it is easy to remove the switching mechanism entirely from the case. This is effective to improve the maintenance ability. It is also possible to remove the switching mechanism entirely to replace for a switching mechanism of a proximity switch type. This is effective to improve the compatibility.

Having described the embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A pump system, comprising:

a pump including a pump head having an inlet and an outlet for a target fluid to be transferred and including a valve unit for routing said target fluid from said inlet to said outlet, a shaft passing through said pump head for reciprocating therethrough, first and second flexible members linked to both ends of said shaft to form first and second pump chambers at both sides of said pump shaft for introducing said target fluid through said valve unit, first and second cases for housing said first and second flexible members individually to form first and second actuating fluid chambers for introducing an actuating fluid into a space between the first flexible member and the first case and a space between the second flexible member and the second case, and first and second switching mechanisms detachably attached to said cases from outside and located in the axial direction at both sides of said shaft, having flow paths formed therein for branching part of said actuating fluid and including movable members reciprocating together with said shaft wherein in a state of normal operation the movable members are in contact but not rigidly attached to said shaft, in which said movable member opens said flow path to branch part of said actuating fluid as a control fluid when said shaft reaches one limit of reciprocation; and a switching valve mechanism for alternately distributing an actuating fluid supplied from an actuating fluid source to said pair of actuating fluid chambers using said control fluid branched at said switching mechanisms, wherein said actuating fluid is alternately introduced into said pair of actuating fluid chambers to drive said shaft back and forth in opposite phases to suck and discharge said target fluid.

2. The pump system according to claim 1, wherein the switching valve mechanism includes:

a switching valve mechanism body having a distribution chamber formed therein for distributing said actuating fluid, and a switching valve capable of reciprocating and located inside said distribution chamber in said switching valve mechanism body, said switching valve mechanism body having an introduction orifice formed for introducing said actuating fluid from said actuating fluid source into said distribution chamber, first and second actuating fluid orifices formed for discharging said actuating fluid introduced into said distribution chamber to said pump and introducing said actuating fluid discharged from said pump into said distribution chamber, first and second discharge orifices formed for discharging said actuating fluid discharged from said pump, and first and second control fluid orifices formed for introducing and discharging a part of said actuating fluid as a control fluid branched from said actuating fluid, said switching valve being operative to switch between a first state and a second state when said control fluid drives said switching valve back and forth, in said first state said introduction orifice communicates with said first actuating fluid orifice and said second actuating fluid orifice communicates with said second discharge orifice, in said second state said introduction orifice communicates with said second actuating fluid orifice and said first actuating fluid orifice communicates with said first discharge orifice.

3. The pump system according to claim 2, further comprising:

a first main conduit for connecting said first actuating fluid orifice in said switching valve mechanism with said first actuating chamber;

a second main conduit for connecting said second actuating fluid orifice in said switching valve mechanism with said second actuating chamber;

a first control fluid introduction path for introducing part of said actuating fluid as a control fluid into a flow path in said first switching mechanism;

a second control fluid introduction path for introducing part of said actuating fluid as a control fluid into a flow path in said second switching mechanism;

a first control fluid conduit for introducing said control fluid discharged from said flow path in said first switching mechanism into said first control fluid orifice in said switching valve mechanism; and a second control fluid conduit for introducing said control fluid discharged from said flow path in said second switching mechanism into said second control fluid orifice in said switching valve mechanism.

4. The pump system according to claim 1, said switching mechanism including a cylinder detachably fixed to said case from outside and having a discharge orifice for said control fluid formed at a side, and a rod serving as said movable member for reciprocating along with said shaft within said cylinder, having an introduction orifice for said actuating fluid or said control fluid formed at an end, and a discharge orifice for said control fluid formed in communication with said introduction orifice at a side, wherein said discharge orifice in said rod communicates with said discharge orifice in said cylinder when said rod reaches one of limits of reciprocation thereof.

5. The pump system according to claim 1, said flexible member comprises a bellows or diaphragm.

6. The pump system according to claim 1, said switching mechanism is composed of a ceramic or resin.

7. The pump system according to claim 2, said switching mechanism is composed of a ceramic or resin.

8. The pump system according to claim 3, said switching mechanism is composed of a ceramic or resin.

9. The pump system according to claim 4, said switching mechanism is composed of a ceramic or resin.

10. The pump system according to claim 5, said switching mechanism is composed of a ceramic or resin.

* * * * *

UNITED STATES PATENT AND TRADEMARK OFFICE

CERTIFICATE OF CORRECTION

PATENT NO. : 6,874,997 B2
APPLICATION NO. : 10/290169
DATED : April 5, 2005
INVENTOR(S) : Tsuyoshi Watanabe et al.

It is certified that error appears in the above-identified patent and that said Letters Patent is hereby corrected as shown below:

On column 16, line 27, please add the following claims:

11. The pump system according to claim 1, said switching mechanism including a movable member case detachably fixed to said case from outside and having a discharge orifice for said control fluid formed at a side, a rod serving as said movable member for reciprocating within said movable member case, said rod having a tip protruded from said movable member case and contacted with said flexible member, an introduction orifice for said control fluid formed in said tip contacted with said flexible member, and a discharge orifice for said control fluid formed in communication with said introduction orifice at a certain location, and a resilient member for driving said rod toward said flexible member, wherein said tip of said rod separates from said flexible member and said discharge orifice in said rod communicates with said discharge orifice in said cylinder when said shaft reaches in the vicinity of one of limits of reciprocation thereof.

12. The pump system according to claim 1, said switching mechanism including a ball valve case detachably fixed to said case from outside and having an introduction orifice for said control fluid formed at an end and a discharge orifice for said control fluid formed at a side, a rod serving as said movable member for reciprocating within said ball valve case and having a tip protruded from said ball valve case, in which said rod contacts with said flexible member and moves back when said flexible member reaches in the vicinity of a limit of reciprocation, and a ball valve housed in said ball valve case, in which said ball valve is opened to communicate said introduction orifice with said discharge orifice for said control fluid when said rod moves back and the rear end of said rod pushes said rod.

UNITED STATES PATENT AND TRADEMARK OFFICE

CERTIFICATE OF CORRECTION

PATENT NO. : 6,874,997 B2
APPLICATION NO. : 10/290169
DATED : April 5, 2005
INVENTOR(S) : Tsuyoshi Watanabe et al.

It is certified that error appears in the above-identified patent and that said Letters Patent is hereby corrected as shown below:

13. The pump system according to claim 11, said switching mechanism is composed of a ceramic or resin.

14. The pump system according to claim 12, said switching mechanism is composed of a ceramic or resin.

Signed and Sealed this

Seventh Day of August, 2007

JON W. DUDAS
*Director of the United States Patent and Trademark Office*